US012458203B2

(12) United States Patent
Kim et al.

(10) Patent No.: US 12,458,203 B2
(45) Date of Patent: Nov. 4, 2025

(54) CUTLERY BASKET AND DISHWASHER COMPRISING SAME

(71) Applicant: SAMSUNG ELECTRONICS CO., LTD., Suwon-si (KR)

(72) Inventors: Jusik Kim, Suwon-si (KR); Kyuha Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/750,989

(22) Filed: Jun. 21, 2024

(65) Prior Publication Data

US 2024/0341564 A1 Oct. 17, 2024

Related U.S. Application Data

(63) Continuation of application No. PCT/KR2022/018911, filed on Nov. 28, 2022.

(30) Foreign Application Priority Data

Dec. 31, 2021 (KR) ..... 10-2021-0194536

(51) Int. Cl.
*A47L 15/50* (2006.01)

(52) U.S. Cl.
CPC ..... *A47L 15/502* (2013.01)

(58) Field of Classification Search
CPC ..... A47L 15/50; A47L 15/501; A47L 15/502; A47L 15/503; A47L 15/505;
(Continued)

(56) References Cited

U.S. PATENT DOCUMENTS 2,589,423 A * 3/1952 Nadolsky ..... B65D 85/305 220/756
5,431,294 A * 7/1995 Stottmann ..... A47L 15/502 220/759

(Continued)

FOREIGN PATENT DOCUMENTS

CN 201005658 Y 1/2008
CN 207477473 U 6/2018

(Continued)

OTHER PUBLICATIONS

International Search Report and Written Opinion of the International Searching Authority dated Mar. 22, 2023, in connection with International Application No. PCT/KR2022/018911, 9 pages.

(Continued)

*Primary Examiner* — Patrick D Hawn

(57) ABSTRACT

A dishwasher is disclosed. The dishwasher comprises: a cabinet; a washing tub provided inside the cabinet; and a cutlery basket inside the washing tub and including a first sidewall, a second side wall opposite to the first sidewall, a main body including first holes formed in the first and second sidewalls and second holes spaced apart from the first holes at right angles, and a handle including a first fastener facing the outer surface of the first side wall, a second fastener facing the outer surface of the second sidewall, and a grip connecting the first and second fasteners, first and second protrusions formed on each of the first and second fasteners and the first protrusions inserted into the first holes and have an upper surface contacting the main body, and the second protrusions are inserted into the second holes and have a lower surface contacting the main body.

19 Claims, 7 Drawing Sheets

1

(58) Field of Classification Search
CPC ... A47L 15/507; B65D 25/04; B65D 25/2826; B65D 25/2832; B65D 25/2805; B65D 25/2829; B65D 25/282; B65D 25/2802; B65D 25/2867; B65D 1/38
See application file for complete search history.

(56) References Cited

U.S. PATENT DOCUMENTS

| | | | | |
|---|---|---|---|---|
| 7,073,682 | B2 * | 7/2006 | Raches | A47L 15/502 220/691 |
| 7,694,844 | B2 * | 4/2010 | Woo | A47L 15/502 220/756 |
| 8,377,227 | B2 * | 2/2013 | Bengston | A47L 15/502 134/201 |
| 9,161,677 | B2 | 10/2015 | Hofpeter et al. | |
| 9,173,544 | B2 | 11/2015 | Ayvazoglu et al. | |
| 9,635,996 | B2 | 5/2017 | Alwin | |
| 9,661,982 | B2 * | 5/2017 | Dabade | A47L 15/502 |
| 9,848,753 | B2 * | 12/2017 | Chan | A47L 15/505 |
| 9,888,830 | B2 * | 2/2018 | Hirsh | A47L 15/502 |
| 10,676,241 | B1 * | 6/2020 | Kaldahl | B65D 25/2858 |
| 10,870,512 | B2 * | 12/2020 | Montanari Ibarra | B65D 25/282 |
| 11,497,381 | B2 * | 11/2022 | Boyer | A47L 15/507 |
| 2002/0139809 | A1 * | 10/2002 | Barry | A47L 15/502 220/762 |
| 2004/0094555 | A1 * | 5/2004 | Raches | A47L 15/502 220/487 |
| 2005/0045215 | A1 * | 3/2005 | Raches | A47L 15/502 134/179 |
| 2016/0088997 | A1 | 3/2016 | Alwin | |

FOREIGN PATENT DOCUMENTS

| | | | | |
|---|---|---|---|---|
| CN | 209032265 | U | 6/2019 | |
| CN | 209346966 | U | 9/2019 | |
| CN | 209499670 | U | 10/2019 | |
| CN | 110870752 | A | 3/2020 | |
| DE | 9206050 | U1 | 7/1992 | |
| DE | 60305317 | T2 * | 2/2007 | A47L 15/502 |
| DE | 102015103781 | A1 * | 10/2015 | A47L 15/502 |
| EP | 1256309 | A1 | 11/2002 | |
| EP | 2453788 | B1 * | 11/2015 | A47L 15/502 |
| GB | 2255711 | A | 11/1992 | |
| KR | 10-1268650 | B1 | 5/2013 | |

OTHER PUBLICATIONS

Supplementary European Search Report dated Jan. 9, 2025, in connection with European Patent Application No. 22916462.9, 10 pages.

* cited by examiner

CUTLERY BASKET AND DISHWASHER COMPRISING SAME

CROSS-REFERENCE TO RELATED APPLICATION(S)

This application is a Bypass Continuation of International Application No. PCT/KR2022/018911, filed Nov. 28, 2022, which claims priority to Korean Patent Application No. 10-2021-0194536, filed Dec. 31, 2021, the disclosures of which are herein incorporated by reference in their entirety.

BACKGROUND

1. Field

The disclosure relates to a cutlery basket and a dishwasher comprising the same, and more particularly to a cutlery basket having an improved structure for a main body and a handle of the cutlery basket to be stably fastened while having a compact exterior, and a dishwasher comprising the same.

2. Description of Related Art

In general, dishwashers are apparatuses that wash dishes by spraying high-pressured washing water to the dishes, and include a cabinet in which a dishwashing tub is provided inside thereof, a dish basket in which dishes are loaded and installed movably inside the dishwashing tub, a cutlery basket in which cutlery is filled, and a spraying unit configured to spray washing water to the dish basket and the cutlery basket.

A user may fill small cutlery such as spoons, knives, and forks in a main body of the cutlery basket, and then arrange the cutlery basket at a specific position of the dish basket while grasping a handle of the cutlery basket. However, the cutlery basket in the related art has had a problem of having an unappealing exterior and injuries occurring due to a hand of the user being scratched by a fastening structure as an assembly structure of the main body and the handle are exposed to the outside.

SUMMARY

The disclosure is to solve the above-described problem, and an object of the disclosure is in providing a cutlery basket having an improved structure for a main body and a handle of the cutlery basket to be stably fastened while having a compact exterior, and a dishwasher comprising the same.

According to an embodiment of the disclosure, a dishwasher includes a cabinet forming an exterior, a dishwashing tub provided at an inside of the cabinet, and a cutlery basket placed at an inside of the dishwashing tub, and the cutlery basket includes a main body including a first sidewall, a second sidewall arranged facing the first sidewall, a pair of first holes formed at the first and second sidewalls, respectively, and a pair of second holes arranged to be spaced apart and perpendicular to the first hole, a handle including a first fastener facing an outer side surface of the first sidewall, a second fastener facing an outer side surface of the second sidewall, and a grip connecting the first and second fasteners, a first protrusion formed at each of the first and second fasteners and inserted in a first hole, and including a top surface which contacts with the main body, and a second protrusion formed at each of the first and second fasteners and inserted in a second hole, and including a bottom surface that contacts the main body.

The first protrusion may be configured such that an end that passes through the first hole is bent toward an upper side.

The second protrusion may be arranged at an upper side of the first protrusion.

The second protrusion may include a support area including a bottom surface that contacts the main body, and an inclined area including an inclined surface that is formed to be in a downward incline as the incline surface moves away from the handle, and is connected to a top surface of the support area.

The main body may include a pair of ribs arranged respectively at the pair of second holes, and include a top surface that contacts the bottom surface of the second protrusion.

The rib may be protrudingly formed from the bottom surface of the second hole toward an upper side, and arranged spaced apart from a side surface of the second hole.

The main body may include a pair of elastic supports which respectively support inner side surfaces of the pair of ribs, and have widths smaller than the ribs.

The main body may store cutlery in an inner space of which an upper part is opened, and include a plate arranged perpendicularly to divide the inner space, and the pair of elastic supports may be formed to protrude from an upper end of the plate toward the ribs.

The main body may include a pair of third holes formed respectively at the first and second sidewalls, and arranged at an upper side than the first and second holes, and the cutlery basket may further include a third protrusion formed at the first and second fasteners, respectively, and inserted in third hole, and including a top surface that contacts the main body.

The third protrusion may be configured such that one end that passes through the third hole is bent toward an upper side.

The first to third protrusions may be arranged at regular intervals along length directions of the first and second fasteners.

The main body may include a pair of grooves respectively formed at the first and second sidewalls and in which the first and second fasteners are respectively inserted.

According to an embodiment of the disclosure, a cutlery basket includes a main body including a first sidewall, a second sidewall arranged facing the first sidewall, and three pairs of holes formed at the first and second sidewalls, respectively, and arranged to be spaced apart and perpendicular to one another, a handle including a first fastener facing an outer side surface of the first sidewall, a second fastener facing an outer side surface of the second sidewall, and a grip connecting the first and second fasteners, and three pairs of protrusions respectively formed at the first and second fasteners and inserted in each of the three pairs of holes, and the three pairs of protrusions include two pairs of protrusions including top surfaces that contact the main body, and a third pair of protrusions including bottom surfaces that contact the main body.

The third pair of protrusions may be arranged between the two pairs of protrusions.

The three pairs of protrusions may be arranged at regular intervals along length directions of the first and second fasteners.

According to an embodiment of the disclosure, a cutlery basket includes a main body including a first sidewall, a second sidewall arranged facing the first sidewall, and multiple pairs of holes formed at the first and second sidewalls, respectively, and spaced apart perpendicular to one another, a handle which includes a first fastener facing an outer side surface of the first sidewall, a second fastener facing an outer side surface of the second sidewall, and a grip connecting the first and second fasteners and a plurality of protrusion which are respectively formed at the first and second fasteners and inserted in the multiple pairs of holes.

The multiple pairs of holes may include a pair of first holes and a pair of second holes arranged at an upper side than the first holes, and the plurality of protrusion may include a first protrusion inserted in the first hole and include a top surface that contacts the main body and a second protrusion inserted in the second hole and include a bottom surface that contacts the main body.

The multiple pairs of holes may further include a pair of third holes arranged at an upper side than the first and second holes, and the plurality of protrusion may further include a third protrusion inserted in the third hole and includes a top surface that contacts the main body.

The first and third protrusions may be configured such that one end that passes through each of the first and third holes is bent toward an upper side.

The first to third protrusions may be arranged at regular intervals along length directions of the first and second fasteners.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described below are provided as examples to assist in understanding of the disclosure, and it is to be understood that the disclosure may be variously modified and realized, unlike the embodiments described herein. However, in describing the disclosure, in case it is determined that the detailed description of related known technologies may unnecessarily confuse the gist of the disclosure, the detailed description thereof and the detailed drawing thereof will be omitted. In addition, the accompanied drawing may be shown exaggerated in measurement of some elements rather than being shown according to its actual dimension to assist in the understanding of the disclosure.

Terms used in describing the embodiments of the disclosure are general terms selected considering their function herein. However, the terms may change depending on intention, legal or technical interpretation, emergence of new technologies, and the like of those skilled in the related art. Further, in certain cases, there may be terms arbitrarily selected. The terms described above may be interpreted according to the meaning defined in the disclosure, and if no specific definition is described, the meaning of the term may be interpreted based on the overall context of the disclosure and technical sense common in the corresponding technical field.

In the disclosure, expressions such as "have," "may have," "include," and "may include" are used to designate a presence of a corresponding characteristic (e.g., elements such as numerical value, function, operation, or component), and not to preclude a presence or a possibility of additional characteristics.

Further, because elements necessary in describing each embodiment of the disclosure are described in the disclosure, the embodiments are not limited thereto. Accordingly, some elements may be modified or omitted, and other elements may be added. In addition, the elements may be distributed to devices independent from one another and arranged.

Furthermore, although embodiments of the disclosure have been described in detail below with reference to the accompanied drawings and the descriptions of the accompanied drawings, the disclosure is not limited to the embodiments.

The disclosure will be described in greater detail below with reference to the accompanied drawings.

Figure 1:
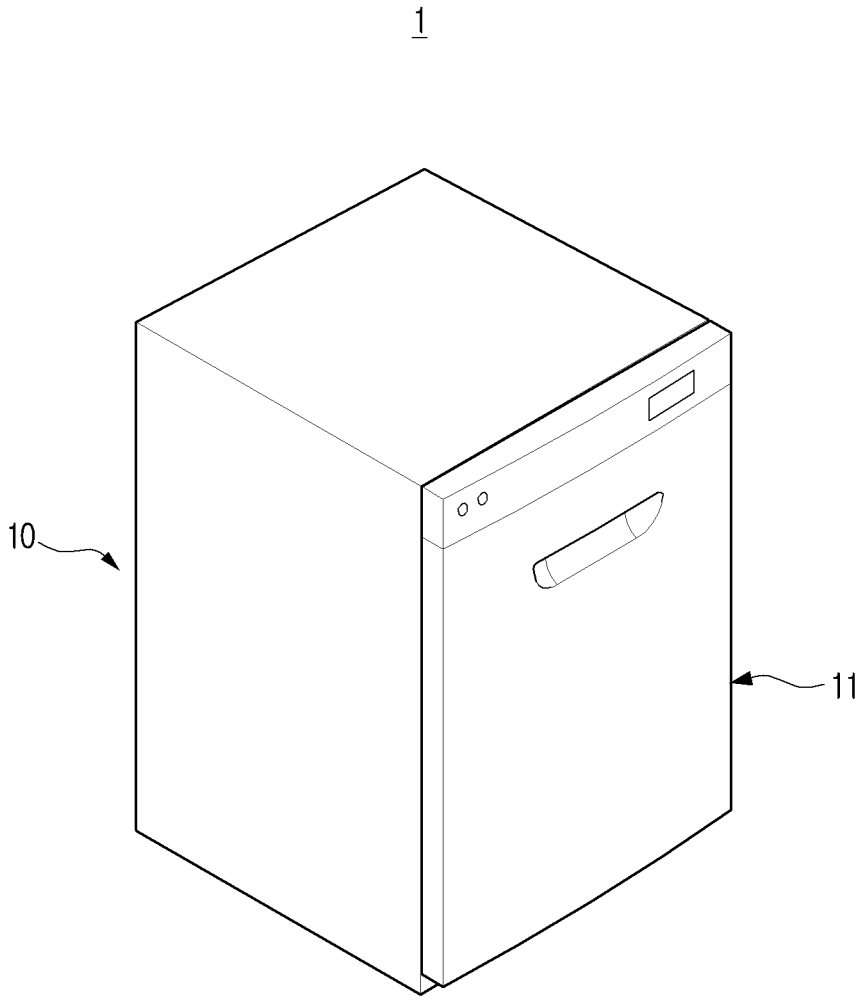
FIG. 1 is a perspective view illustrating a dishwasher according to an embodiment of the disclosure.

FIG. 1 is a perspective view illustrating a dishwasher according to an embodiment of the disclosure.

Referring to FIG. 1, a dishwasher 1 may include a cabinet 10 forming an exterior and a door 11 opening and closing an inside of the cabinet 10.

The dishwasher 1 may be an apparatus that washes by spraying washing water to a washing object such as dishes, and may be classified to various types according to a structure and an arrangement method of the cabinet 10.

The dishwasher 1 may be implemented in a built-in method by being installed in an empty space provided by separating a portion of a cabinet which is an external support, a free-standing method of being arranged independently, a counter top method of being arranged at an upper counter of the cabinet, and the like, and an in-sink method of being integrally manufactured with a sink and installed, and the like. In FIG. 1, the dishwasher 1 has been shown implemented in the built-in method which is commonly used for households, but is not limited thereto.

The door 11 may be rotatably installed at a front surface of the cabinet 10, a control device with which a user can control the dishwasher 1 may be provided at an upper part of the door 11, and the user may easily operate the dishwasher 1 by opening and closing the door 11.

Figure 2:
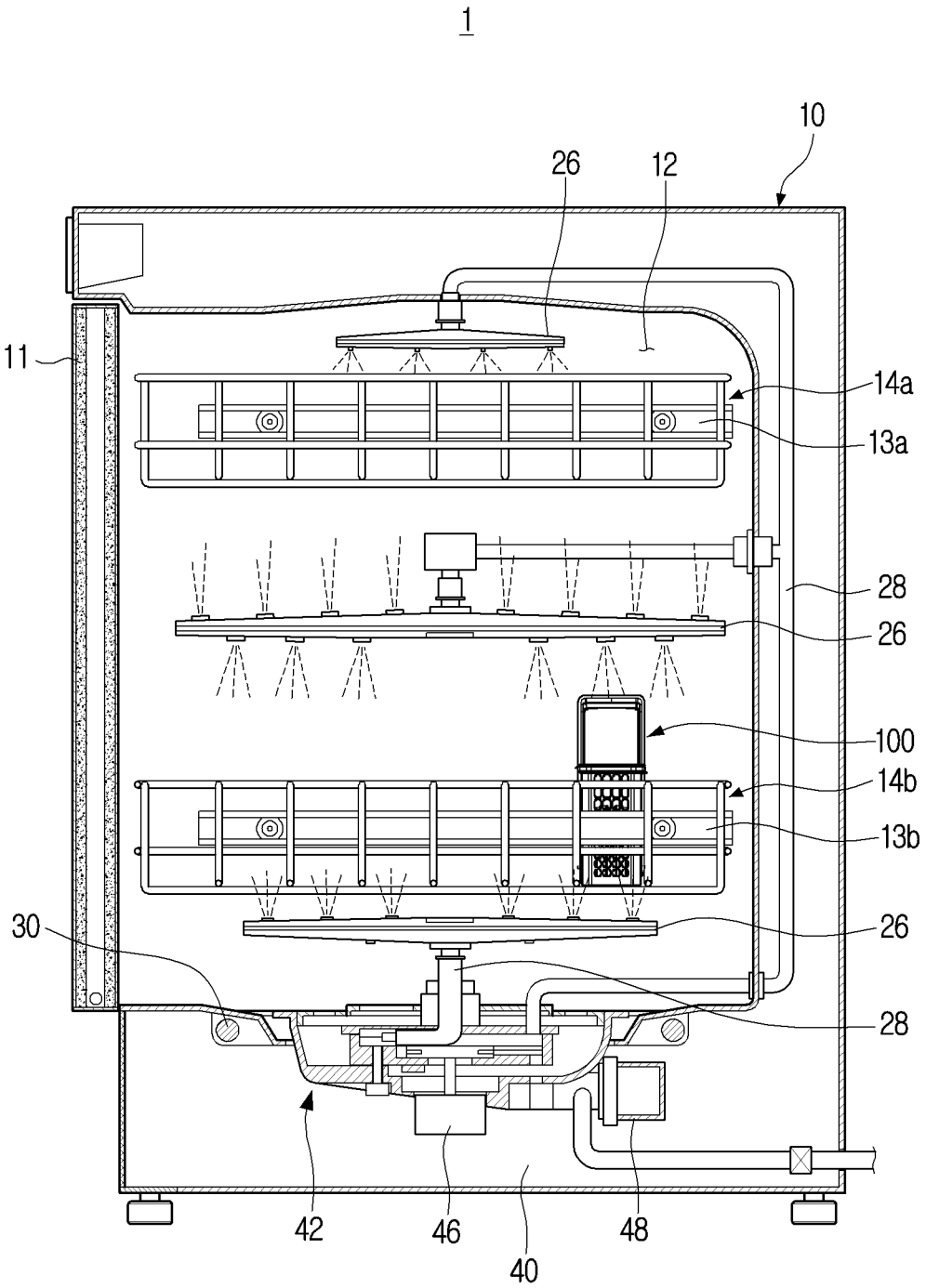
FIG. 2 is a cross-sectional view illustrating a schematic configuration of a dishwasher according to an embodiment of the disclosure.

FIG. 2 is a cross-sectional view illustrating a schematic configuration of a dishwasher according to an embodiment of the disclosure.

Referring to FIG. 2, the dishwasher 1 according to an embodiment of the disclosure may include the cabinet 10, a dishwashing tub 12, and a machinery compartment 40.

The dishwashing tub 12 may be a space provided inside the cabinet 10, and dish baskets 14*a* and 14*b* in which dishes that are washing objects are loaded may be arranged at an inside of the dishwashing tub 12.

The dish baskets 14*a* and 14*b* may include an upper dish basket 14*a* and a lower dish basket 14*b*. The upper dish basket 14*a* may be supported by an upper rack 13*a*, and the lower dish basket 14*b* may be supported by a lower rack 13*b*. The upper rack 13*a* and the lower rack 13*b* may be provided to be slidable forwards and backwards inside of the dishwashing tub 12.

A spray nozzle 26 spraying washing water toward the dish baskets 14*a* and 14*b* may be arranged inside the dishwashing tub 12.

The spray nozzle 26 may include an upper, middle, and lower spray nozzles 26. The upper spray nozzle 26 may be provided at an upper part of the upper dish basket 14*a* and may spray washing water toward a lower side thereof. The middle spray nozzle 26 may be provided between the upper and lower dish baskets 14*a* and 14*b* and may spray washing water toward an upper side and a lower side thereof. The lower spray nozzle 26 may be provided at a lower part of the lower dish basket 14*b* and may spray washing water toward an upper side thereof.

The spray nozzle 26 may receive supply of washing water by being connected with a sump 42 by a supply line 28. The spray nozzle 26 may evenly spray, by being rotated by spraying of washing water, the washing water to washing objects stored in the dish baskets 14*a* and 14*b*.

A heater 30 heating the washing water may be provided at a bottom surface of the dishwashing tub 12, and the machinery compartment 40 may be provided at a lower part of the dishwashing tub 12.

The sump 42 which collects and pumps the washing water supplied to the inside of the dishwashing tub 12 and moves the washing water to the spray nozzle 26 may be provided inside of the machinery compartment 40.

In addition, various flow paths and a circulation pump 46 for pumping water to the flow paths may be provided in the sump 42, and a drain pump 48 discharging contaminated washing water to the outside through a drain line may be provided at one side of the sump 42.

An operating process of the dishwasher 1 configured as described above will be described below.

First, when power is applied while washing objects to be washed are stored in the dish baskets 14*a* and 14*b* inside the dishwashing tub 12, the washing water necessary for washing may begin to be supplied inside the dishwashing tub 12 through a washing water supply hole.

The washing water being supplied inside the dishwashing tub 12 may be collected inside the sump 42 which is provided at the lower part of the dishwashing tub 12, and then a washing cycle may be carried out by the washing water collected by a pumping action of the circulation pump 46 inside the sump 42 being supplied to the spray nozzle 26 through the supply line 28 and spraying the washing water to the washing objects stored in the dish baskets 14*a* and 14*b* in high-pressure.

When the washing cycle is completed, because not only the washing water, but also contaminants on the washing object is washed by the washing water and collected in the sump 42, the washing water included with the contaminants may be discharged to the outside through a drain line according to an operation of the drain pump 48.

When the washing water included with the contaminants is discharged to the outside, the washing water which is clean again through the washing water supply hole may be collected in the sump 42, and a rinse cycle may be carried out by spraying the washing water to the washing object in high-pressure through each spray nozzle 26 identically as the above-described washing cycle.

When the rinse cycle is completed, a drying cycle is performed. In the drying cycle, the washing water heated by the operation of the heater 30 becomes high-temperature washing water and is sprayed on the cleaning object. The high-temperature washing water is vaporized and dried along with the remaining washing water in an evaporation process. Alternatively, hot air of high-pressure may be sprayed as the drying cycle. When drying is complete, the washing process may be ended.

In the dish baskets 14*a* and 14*b*, a cutlery basket 100 in which spoons, chop sticks, knives, forks, and the like can be stored may be attachably or detachably mounted. The cutlery basket 100 has been shown as placed on the lower dish basket 14*b*, but is not limited thereto, and may also be placed on the upper dish basket 14*a*. The cutlery basket 100 may arrange cutlery such as spoons or forks within the dishwashing tub 12 for the cutlery to be washed. A structure of the cutlery basket 100 will be described in greater detail with reference to FIG. 3 and FIG. 4.

Figure 3:
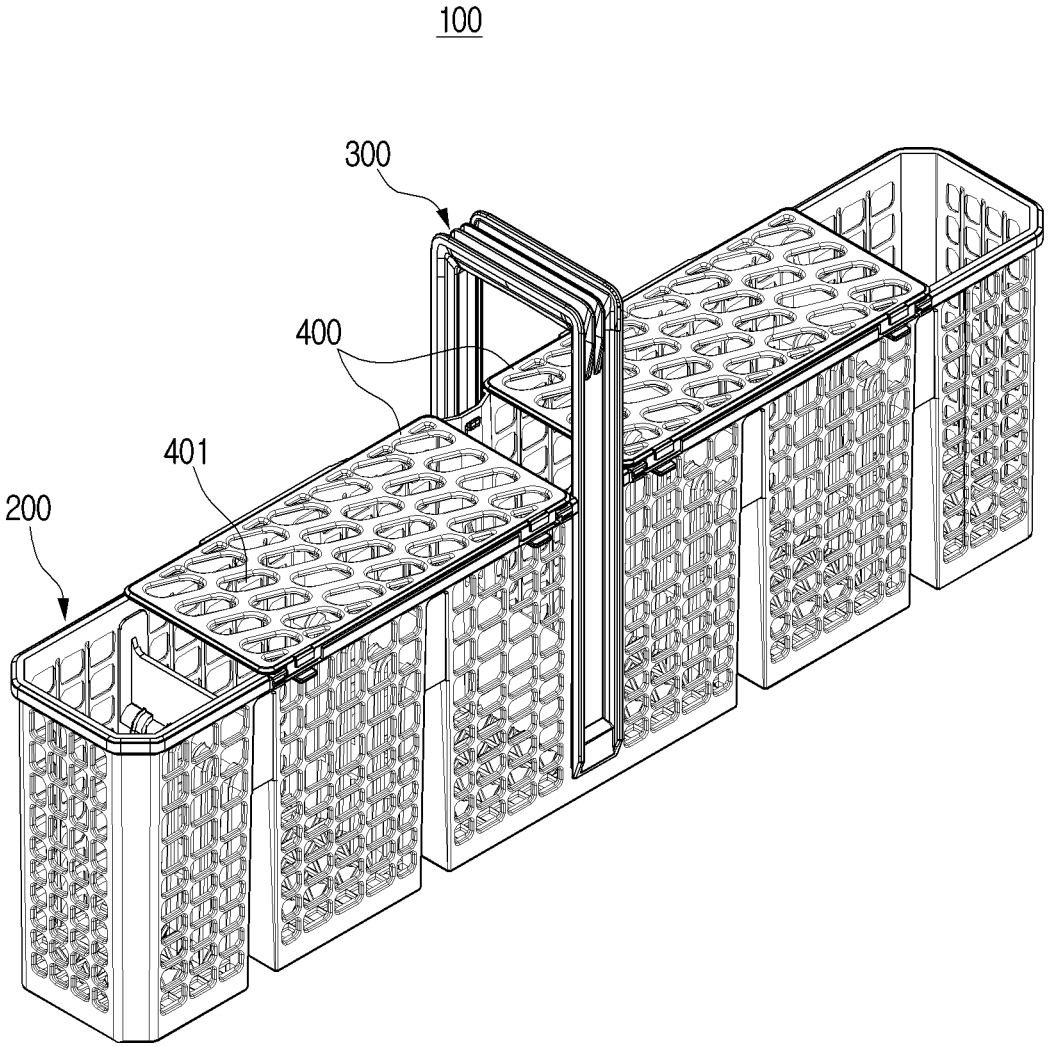
FIG. 3 is a perspective view illustrating a cutlery basket according to an embodiment of the disclosure.
Figure 4:
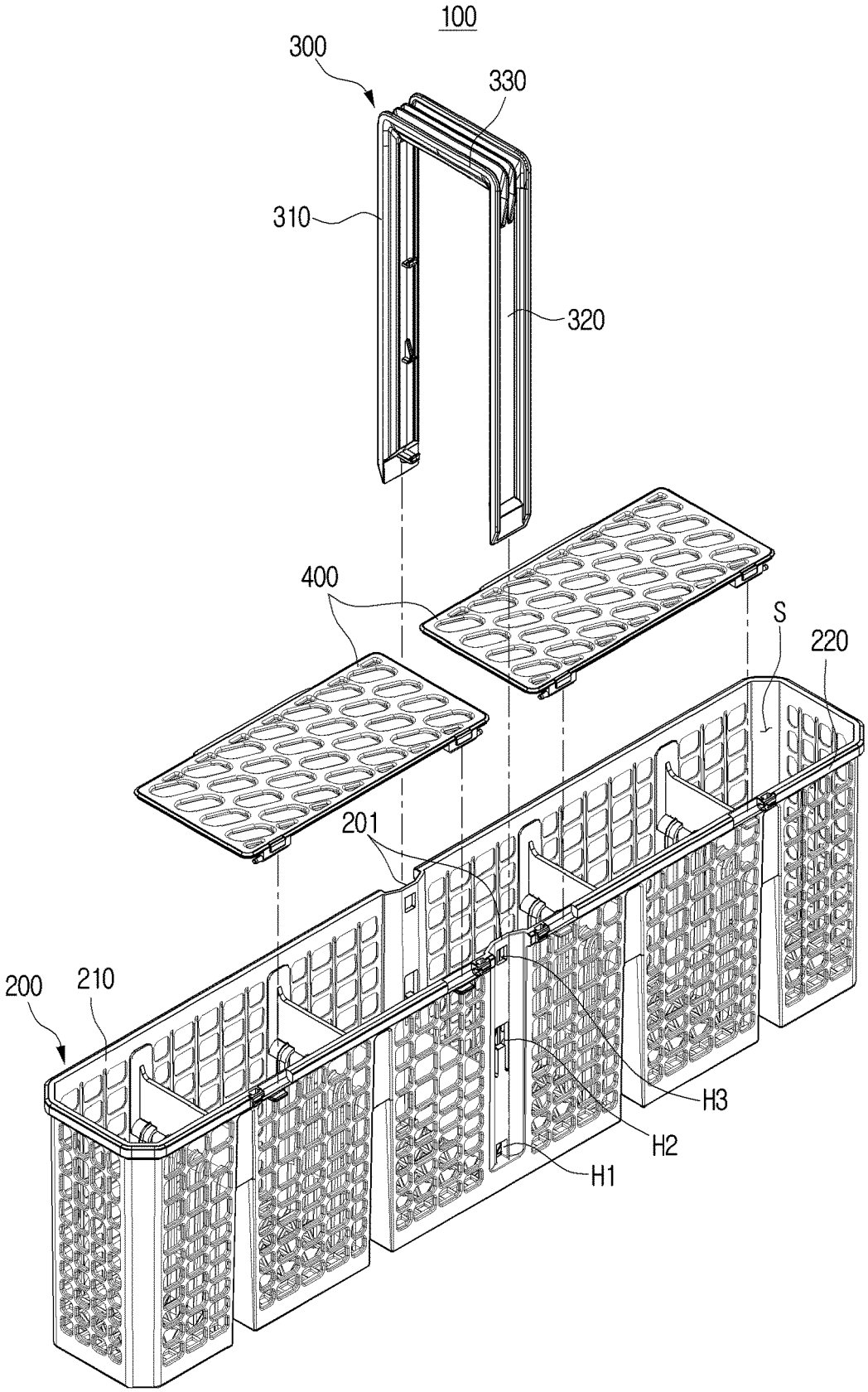
FIG. 4 is an exploded perspective view illustrating a cutlery basket according to an embodiment of the disclosure.

FIG. 3 is a perspective view illustrating a cutlery basket according to an embodiment of the disclosure. FIG. 4 is an exploded perspective view illustrating a cutlery basket according to an embodiment of the disclosure.

Referring to FIG. 3 and FIG. 4, the cutlery basket 100 according to an embodiment of the disclosure may include a main body 200, a handle 300, a cover 400, a first protrusion 500, and a second protrusion 600.

The main body 200 may store the cutlery in an inner space S of which an upper part is opened, and include a first sidewall 210 and a second sidewall 220 which is arranged facing the first sidewall 210. The main body 200 may include four sidewalls and a bottom part connecting lower ends of the sidewalls, and have a rough rectangular parallelepiped shape.

The first sidewall 210 and the second sidewall 220 may be arranged in parallel to each other along a length direction of the main body 200.

The main body 200 may include first to third holes H1, H2, and H3 formed within a groove 201. The first to third holes H1, H2, and H3 may be respectively inserted with first to third protrusions 500, 600, and 700 (FIG. 5) formed at first and second fasteners 310 and 320 which will be described below. Accordingly, a first fastener 310 may be fastened at the first sidewall 210 of the main body 200, and a second fastener 320 may be fastened at the second sidewall 220 of the main body 200.

The handle 300 may include the first fastener 310, the second fastener 320, and a grip 330. The first fastener 310 may be fastened to the first sidewall 210 of the main body 200, and the second fastener 320 may be fastened to the second sidewall 220 of the main body 200. The grip 330 may connect the first and second fasteners 310 and 320. The user may move the whole cutlery basket 100 to a desired position grasping the grip 330.

The first and second fasteners 310 and 320 may be arranged in parallel to each other. The first and second fasteners 310 and 320 may both have a same length, and arranged perpendicularly.

The grip 330 may connect upper ends of the first and second fasteners 310 and 320.

The handle 300 may have a "U" shape. That is, the first and second fasteners 310 and 320 may be arranged perpendicularly, and the grip 330 which connects the first and second fasteners 310 and 320 may be arranged horizontally.

The main body 200 may include a pair of grooves 201 which are formed perpendicular to the respective first and second sidewalls 210 and 220. The grooves 201 may be formed concavely from the first and second sidewalls 210 and 220 toward the inner space S.

The first and second fasteners 310 and 320 of the handle 300 may be inserted into the pair of grooves 201, respectively. Thicknesses of the first and second fasteners 310 and 320 may correspond to depths of the pair of grooves 201, respectively. Accordingly, because there is no stepped level formed between outer side surfaces 211 and 221 of the first and second sidewalls 210 and 220 and outer side surfaces of the first and second fasteners 310 and 320, the cutlery basket 100 may have a compact and smooth exterior.

The cover 400 may close a portion from among the opened upper part of the inner space S of the main body 200. The cover 400 may include a plurality of holes 401 formed in a vertical direction. A plurality of cutlery may be supported by the cover 400 having respectively passed through different holes 401 from each other of the cover 400. Accordingly, the plurality of cutlery may be effectively washed without overlapping with one another.

Figure 5:
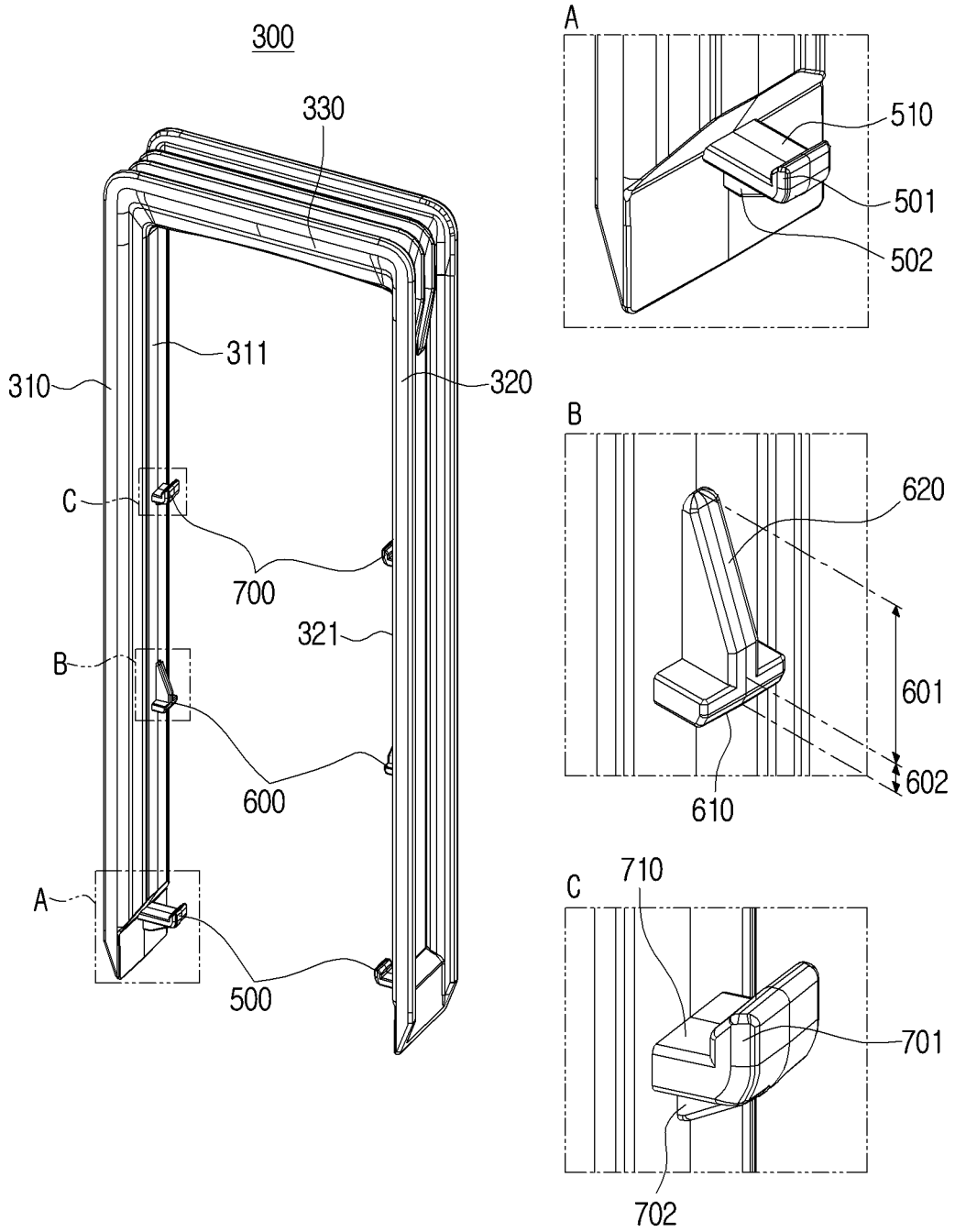
FIG. 5 is a view illustrating a structure of a handle and a protrusion according to an embodiment of the disclosure.
Figure 6:
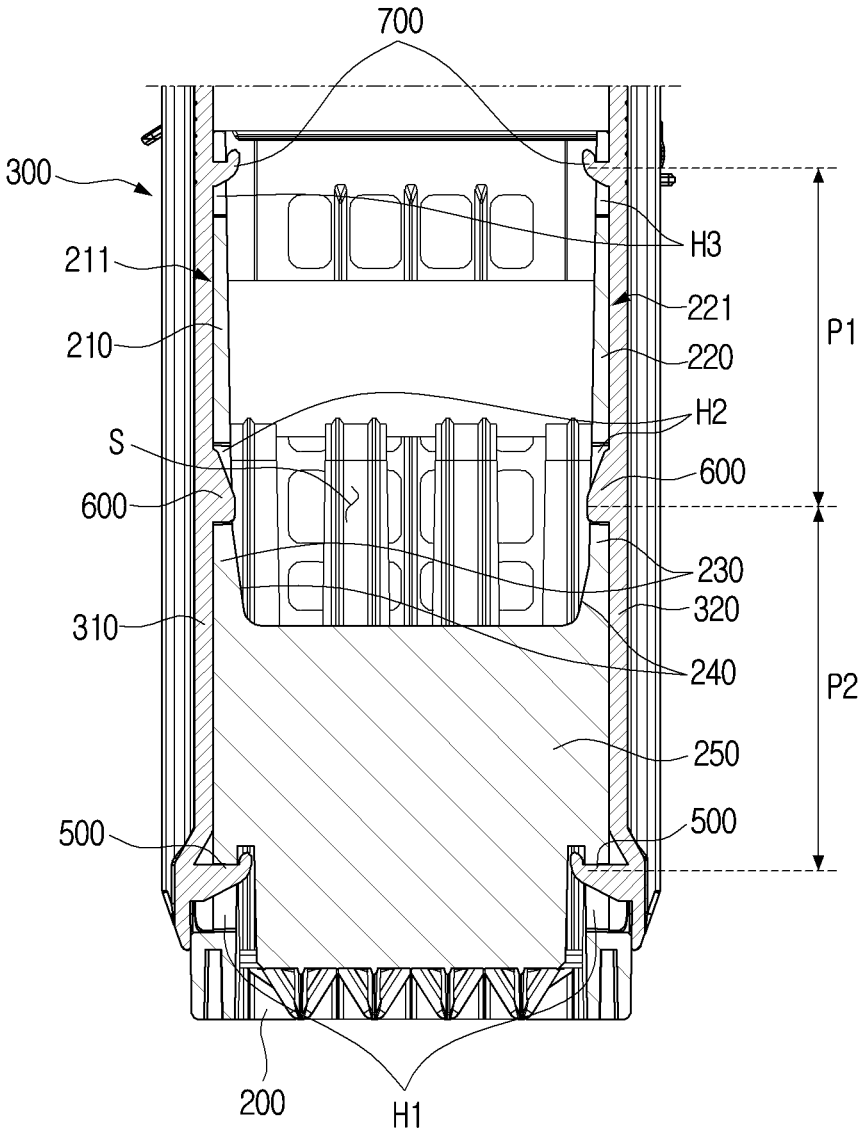
FIG. 6 is a cross-sectional view illustrating a fastening structure of a main body and a handle of a cutlery basket.

FIG. 5 is a view illustrating a structure of a handle and a protrusion according to an embodiment of the disclosure. FIG. 6 is a cross-sectional view illustrating a fastening structure of a main body and a handle of a cutlery basket.

Referring to FIG. 5 and FIG. 6, the main body 200 may include multiple pairs of holes H1 and H2 which are formed respectively at the first and second sidewalls 210 and 220 and spaced apart perpendicular to one another.

In addition, the cutlery basket 100 may include a plurality of protrusions 500 and 600 inserted in the multiple pairs of holes H1 and H2 formed at the first and second fasteners 310 and 320, respectively.

Specifically, a pair of first holes H1 which are formed at the first and second sidewalls 210 and 220, respectively, may be included. In addition, the main body 200 may include a pair of second holes H2 formed at the first and second sidewalls 210 and 220, respectively. The second holes H2 may be arranged spaced apart perpendicular to first holes H1.

The second holes H2 may be arranged at upper sides of the first holes H1 with respect to the vertical direction, but is not limited thereto, and the second holes H2 may be arranged at a lower side of the first hole H1.

The pair of first holes H1 may be formed such that one is formed at the first sidewall 210, and the other is formed at the second sidewall 220. The pair of first holes H1 may be arranged at a same height. The pair of second holes H2 may be formed such that one is formed at the first sidewall 210, and the other is formed at the second sidewall 220. The pair of second holes H2 may be arranged at a same height.

The first and second fasteners 310 and 320 may respectively include the first protrusion 500 and the second protrusion 600 which are respectively inserted in the first and second holes H1 and H2 formed at inner side surfaces 311 and 321 facing each other.

The first and second fasteners 310 and 320 may be arranged at an outer side of the main body 200. That is, an inner side surface 311 of the first fastener 310 may face an outer side surface 211 of the first sidewall 210, and an inner side surface 321 of the second fastener 320 may face an outer side surface 221 of the second sidewall 220.

Accordingly, because protrusions are formed at the inner side surfaces 311 and 321 of the first and second fasteners 310 and 320, and the protrusions and fastening structures of the holes are not exposed to the outside due to the first and second fasteners 310 and 320 covering the holes formed at the first and second sidewalls 210 and 220 of the main body 200, the cutlery basket 100 according to an embodiment of the disclosure may have a compact exterior.

The first protrusion 500 may include a top surface 510 which contacts with the main body 200. The top surface 510 may be arranged horizontally. Based on the top surface 510 of the first protrusion 500 interfering with the main body 200, when the user lifts up the handle 300, the main body 200 may also be lifted up toward the upper side together with the handle 300. In addition, the handle 300 may be limited in movement toward the upper side with respect to the main body 200.

The second protrusion 600 may include a bottom surface 610 which contacts with the main body 200. Based on the bottom surface 610 of the second protrusion 600 interfering with the main body 200, the handle 300 may be limited in movement toward the lower side with respect to the main body 200.

The first protrusion 500 formed at the first fastener 310 and the first protrusion 500 formed at the second fastener 320 may be arranged at a same height with each other and have a shape which is symmetrical based on the length direction of the main body 200.

The second protrusion 600 formed at the first fastener 310 and the second protrusion 600 formed at the second fastener 320 may be arranged at a same height with each other and have a shape which is symmetrical based on the length direction of the main body 200.

Based on the first and second protrusions 500 and 600 inserted respectively in the first and second holes H1 and H2 of the main body 200 interfering with the main body 200, the handle 300 may be more stably fixed to the main body 200. Because relative movements in upward and downward directions of the main body 200 and the handle 300 are limited, the user may stably move the cutlery basket 100 to a desired position grasping the handle 300.

One end 501 of the first protrusion 500 may be bent toward an upper side. The one end 501 of the first protrusion 500 may be arranged in the inner space S of the main body 200 by passing through the first hole H1. The one end 501 of the first protrusion 500 interferes with the inner side surfaces of the first and second sidewalls 210 and 220. The first protrusion 500 may be not unintentionally broken away from the first hole H1. Accordingly, the first protrusion 500 can be fastened to the main body 200.

A lower end 502 of the first protrusion 500 may be formed to be in an upward incline toward the inner space S of the main body 200. Accordingly, the top surface 510 of the first protrusion 500 may be such that a horizontal orientation is stably maintained by the lower end 502 of the first protrusion 500, and prevented from being bent toward a lower side even when interfered by the main body 200.

The one end 501 of the first protrusion 500 interferes with the inner side surfaces of the first and second sidewalls 210 and 220. The first protrusion 500 may be not unintentionally broken away from the first hole H1. Accordingly, the first protrusion 500 can be fastened to the main body 200.

The first protrusion 500 may be arranged at lower ends of the first and second fasteners 310 and 320, and the second protrusion 600 may be arranged at an upper side of the first protrusion 500. The first protrusion 500 may support the lower part of the main body 200 toward the upper side. Accordingly, even if the plurality of cutlery are stored in the main body 200, if the user pulls the handle 300 toward the upper side, the main body 200 may also be stably pulled up together with the handle 300.

In addition, a center of gravity of the cutlery and the main body 200 are positioned adjacently to a bottom surface of the main body 200, and as the first protrusion 500 is arranged at the lower end of the first and second fasteners 310 and 320 and support the lower part of the main body 200 toward an upper side, the user may stably pull up the main body 200 and the handle 300.

The second protrusion 600 may include an inclined surface 620 which is formed to be in an downward incline toward the inner space S of the main body 200. The second protrusion 600 may include an inclined area 601 in which the inclined surface 620 is formed and a support area 602 having a bigger cross-section area than the inclined area 601, and is connected with a lower end of the inclined area 601.

Accordingly, the top surface of the support area 602 may be stably supported by the inclined area 601, and because the bottom surface of the main body 200 which has a sufficiently big cross-section area is in contact with the main body 200, the handle 300 may be such that movement toward the lower side thereof is more stably limited.

The main body 200 may include three pairs of holes H1, H2, and H3 which are respectively formed at the first and second sidewalls 210 and 220 and arranged spaced apart perpendicular to each other. That is, the main body 200 may include one pair of third holes H3 which are respectively formed at the first and second sidewalls 210 and 220 and arranged at an upper side than the first and second holes H1 and H2.

The cutlery basket 100 may include three pairs of protrusions 500, 600, and 700 which are respectively formed at the first and second fasteners 310 and 320 and inserted in the three pairs of holes H1, H2, and H3, respectively.

The three pairs of protrusions 500, 600, and 700 may include two pairs of protrusions 500 and 700 which include top surfaces that contact with the main body 200 and a pair of protrusions 600 which include bottom surfaces that contact with the main body 200.

That is, the first and second fasteners 310 and 320 may respective include third protrusions 700 which are respectively inserted in a pair of third holes H3. The third protrusion 700 may include a top surface 710 which contacts with the main body 200.

The third hole H3 may be formed at upper parts of the first and second sidewalls 210 and 220, and the third protrusion 700 may support the upper parts of the first and second sidewalls 210 and 220 toward the upper side thereof.

That is, the first protrusion 500 may support lower parts of the first and second sidewalls 210 and 220 toward the upper side, and the third protrusion 700 may support upper parts of the first and second sidewalls 210 and 220 toward the upper side.

Accordingly, even if the plurality of cutlery are stored in the main body 200, if the user pulls up the handle 300 toward the upper side thereof, the main body 200 may also be stably pulled up together with the handle 300. In addition, because the one ends 501 and 701 of the first and third protrusions 500 and 700 are bent toward an upper side and limit movement in left and right directions of the handle 300, the handle 300 may minimize clearance or vibration in the left and right directions from the main body 200 from a position corresponding to the upper part and the lower part of the main body 200.

Based on the third protrusion 700 inserted in the third hole H3 of the main body 200 interfering with the main body 200, the handle 300 may be more stably fixed to the main body 200. Because relative movements in the upward and downward directions of the main body 200 and the handle 300 are limited, the user may stably move the cutlery basket 100 to a desired position grasping the handle 300.

The one end 701 of the third protrusion 700 may be bent toward the upper side. The one end 701 of the third protrusion 700 may be arranged in the inner space S of the main body 200 by passing through the third hole H3. Accordingly, fastening may be prevented from being released due to the third protrusion 700 being unintentionally broken away from the third hole H3.

A lower end 702 of the third protrusion 700 may be formed to be in an upward incline toward the inner space S of the main body 200. Accordingly, the top surface 710 of the third protrusion 700 may be such that a horizontal orientation is stably maintained by the lower end 702 of the third protrusion 700, and prevented from being bent toward a lower side even when interfered by the main body 200.

The three pairs of protrusions 500, 600, and 700 may be arranged at regular intervals along length directions of the first and second fasteners 310 and 320. That is, the first to third protrusions 500, 600, and 700 may be arranged at regular intervals along the length directions of the first and second fasteners 310 and 320. The length directions of the first and second fasteners 310 and 320 may be in a vertical direction.

The second protrusion 600 may be arranged at an intermediate height of the first protrusion 500 and the third protrusion 700. That is, the second protrusion 600 may be arranged spaced apart in the vertical direction from the third protrusion 700 by a height of P1, and arranged spaced apart in the vertical direction from the first protrusion 500 by a height of P2, and P1 and P2 may be same.

Accordingly, because the first and third protrusions 500 and 700 are arranged at a same distance from the second protrusion 600 while the bottom surface 610 of the second protrusion 600 is supported by the main body 200, the handle 300 may minimize clearance or vibration in the left and right directions from the main body 200 from a position corresponding to the first and third protrusions 500 and 700.

Figure 7:
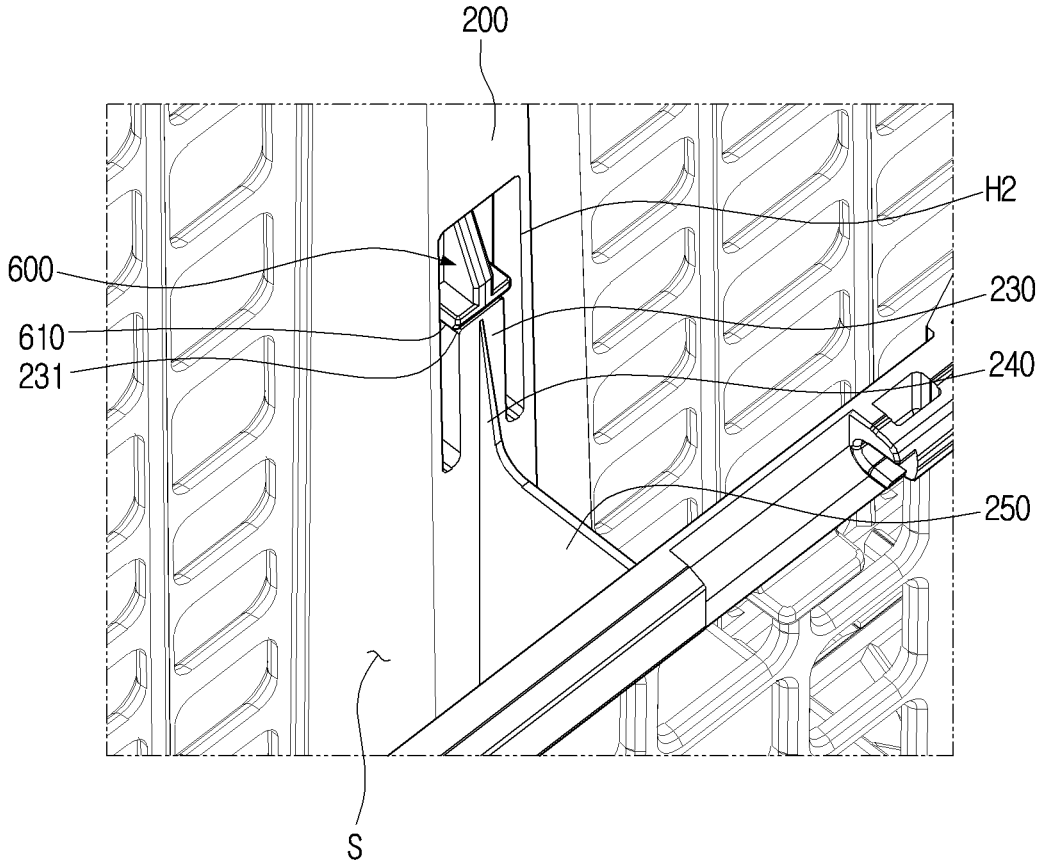
FIG. 7 is an enlarged perspective view illustrating a fastening structure of a second protrusion and a main body.

FIG. 7 is an enlarged perspective view illustrating a fastening structure of a second protrusion and a main body.

Referring to FIG. 6 and FIG. 7, the main body 200 may include a pair of ribs 230. The ribs 230 may have a rectangular parallelepiped shape, but is not limited thereto.

The pair of ribs 230 may include top surfaces 231 which are respectively arranged at the pair of second holes H2 and are in contact with the bottom surface 610 of the second protrusion 600.

The rib 230 may be protrudingly formed from a bottom surface of the second hole H2 toward an upper side, and arranged spaced apart from a side surface of the second hole H2. A width of the rib 230 may be smaller than a width of the second hole H2. A lower end of the rib 230 may be integrally connected with the main body 200, and an upper end may be a free end. Accordingly, the rib 230 may typically maintain a vertical orientation, and may be bent toward an inner side for an upper end of the rib 230 to become closer with the inner space S of the main body 200 when pressed toward the inner space S of the main body 200.

The main body 200 may include a pair of elastic supports 240 which support inner side surfaces of the pair of ribs 230, respectively, and have widths smaller than the ribs 230.

Because the elastic supports 240 provide elastic force to an outer side to the rib 230 even when the second protrusion 600 presses the rib 230 toward the inner side, the rib 230 may be easily restored to the vertical orientation.

The main body 200 may include a plate 250 dividing the inner space S, and the pair of elastic supports 240 may be protrudingly formed from a top surface of the plate 250 toward the rib 230.

The plate 250 may be arranged perpendicularly and divide the inner space S of the main body 200. The plate 250 and the elastic support 240 may be integrally formed and have the same thickness.

Referring to a process of the handle 300 being assembled to the main body 200, the first and second fasteners 310 and 320 the handle may move toward the lower side and open toward the outer side. At this time, the first and third protrusions 500 and 700 may first be inserted respectively in the first and third holes H1 and H3. Simultaneously, the second protrusion 600 may press, without being inserted in the second hole H2, the rib 230 toward the inner space S of the main body 200 while contacting the outer side surface of the rib 230. Accordingly, the upper end of the rib 230 may be bent toward the inner side so as to be close with the inner space S of the main body 200.

Then, when the handle 300 moves toward the upper side, the second protrusion 600 may be inserted in the second hole H2 and the rib 230 may be restored to the vertical orientation and support the bottom surface of the second protrusion 600. Simultaneously, the top surfaces 510 and 710 of the first and third protrusions 500 and 700 may be contacted with the main body 200. Accordingly, because the three pairs of protrusions formed at the inner side surface of the handle 300 are all inserted in corresponding holes of the main body 200, the main body 200 and the handle 300 may be stably fastened to one another.

While the disclosure has been shown and described with reference to the example embodiments thereof, the disclosure is not limited to the embodiments specifically described and various modifications may be made therein by those skilled in the art to which this disclosure pertains without departing from the spirit and scope of the disclosure, and such modifications shall not be understood as separate from the technical concept or outlook of the present disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A dishwasher, comprising:

a cabinet forming an exterior;

a dishwashing tub provided at an inside of the cabinet; and a cutlery basket placed at an inside of the dishwashing tub, wherein the cutlery basket comprises:

a main body comprising:

a first sidewall, a second sidewall arranged facing the first sidewall, a pair of grooves respectively formed perpendicularly on the first sidewall and the second sidewall and formed concavely from the first and second sidewalls toward an inner space, a pair of first holes formed at the pair of grooves of the first sidewall and the second sidewall, respectively, and a pair of second holes formed at the pair of grooves, and arranged to be spaced apart and perpendicular to the first holes, a handle comprising:

a first fastener formed to correspond to depths of the pair of grooves disposed on an outer side surface of the first sidewall and inserted into one of the pair of grooves, a second fastener formed to correspond to depths of the pair of grooves disposed on facing an outer side surface of the second sidewall and inserted into the other of the pair of grooves, and a grip connecting the first fastener and second fastener, a first protrusion formed at each of the first fastener and the second fastener and inserted in a first hole, and comprising a top surface that contacts the main body, and a second protrusion formed at each of the first fastener and the second fastener and inserted in a second hole, and comprising a bottom surface that contacts the main body.

2. The dishwasher of claim 1, wherein the first protrusion is configured such that an end that passes through the first hole is bent toward an upper side.

3. The dishwasher of claim 1, wherein the second protrusion is arranged at an upper side of the first protrusion.

4. The dishwasher of claim 1, wherein the second protrusion comprises:

a support area comprising a bottom surface that contacts the main body, and an inclined area comprising an inclined surface that is formed to be in a downward incline as the inclined surface moves away from the handle, and is connected to a top surface of the support area.

5. The dishwasher of claim 1, wherein the main body comprises:

a pair of ribs arranged respectively at the pair of second holes, and comprise a top surface that contacts the bottom surface of the second protrusion.

6. The dishwasher of claim 5, wherein each rib of the pair of ribs is formed to protrude from the bottom surface of the respective second hole toward an upper side, and arranged to be spaced apart from a side surface of the respective second hole.

7. The dishwasher of claim 6, wherein the main body comprises:

a pair of elastic supports that respectively support inner side surfaces of the pair of ribs, and have widths smaller than the ribs.

8. The dishwasher of claim 7, wherein:

the main body is configured to store cutlery in the inner space of which an upper part is opened, and comprises a plate arranged perpendicularly to divide the inner space, and the pair of elastic supports are formed to protrude from an upper end of the plate toward the ribs.

9. The dishwasher of claim 1, wherein:

the main body comprises:

a pair of third holes formed respectively at the first sidewall and the second sidewall, and arranged at an upper side than the first hole and the second hole, and the cutlery basket further comprises:

a third protrusion formed at the first fastener and the second fastener, respectively, and inserted in a third hole, and comprising a top surface that contacts the main body.

10. The dishwasher of claim 9, wherein the third protrusion is configured such that one end that passes through the third hole is bent toward an upper side.

11. The dishwasher of claim 9, wherein the first protrusion, the second protrusion, and the third protrusion are arranged at regular intervals along length directions of the first fastener and the second fastener.

12. A cutlery basket, comprising:

a main body comprising a first sidewall, a second sidewall arranged facing the first sidewall, and three pairs of holes formed at the first sidewall and the second sidewall, respectively, arranged to be spaced apart and perpendicular to one another, and a pair of grooves respectively formed perpendicularly on the first sidewall and the second sidewall and formed concavely from the first and second sidewalls toward an inner space;

a handle comprising a first fastener formed to correspond to depths of the pair of grooves disposed on an outer side surface of the first sidewall and inserted into one of the pair of grooves, a second fastener formed to correspond to depths of the pair of grooves disposed on an outer side surface of the second sidewall and inserted into the other of the pair of grooves, and a grip connecting the first fastener and the second fastener; and three pairs of protrusions respectively formed at the first fastener and the second fastener and inserted in each of the three pairs of holes, wherein the three pairs of protrusions comprise:

two pairs of protrusions comprising top surfaces that contact the main body, and a third pair of protrusions comprising bottom surfaces that contact the main body.

13. The cutlery basket of claim 12, wherein the third pair of protrusions are arranged between the two pairs of protrusions.

14. The cutlery basket of claim 13, wherein the three pairs of protrusions are arranged at regular intervals along length directions of the first fastener and the second fastener.

15. A cutlery basket, comprising:

a main body including:

a first sidewall, a second sidewall arranged facing the first sidewall, multiple pairs of holes formed at the first and second sidewalls, respectively, and spaced apart perpendicular to one another, and a pair of grooves respectively formed perpendicularly on the first sidewall and the second sidewall and formed concavely from the first and second sidewalls toward an inner space, a handle which includes a first fastener formed to correspond to depths of the pair of grooves disposed on an outer side surface of the first sidewall and inserted into one of the pair of grooves, a second fastener formed to correspond to depths of the pair of grooves disposed on an outer side surface of the second sidewall and inserted into the other of the pair of grooves, and a grip connecting the first and second fasteners and a plurality of protrusions respectively formed at the first and second fasteners and inserted in the multiple pairs of holes.

16. The cutlery basket of claim 15, wherein:

the multiple pairs of holes include a pair of first holes and a pair of second holes arranged at an upper side than the first holes, and the plurality of protrusions include a first protrusion inserted in the first hole and include a top surface that contacts the main body and a second protrusion inserted in the second hole and include a bottom surface that contacts the main body.

17. The cutlery basket of claim 15, wherein:

the multiple pairs of holes may further include a pair of third holes arranged at an upper side than the first and second holes, and the plurality of protrusions further include a third protrusion inserted in the third hole and includes a top surface that contacts the main body.

18. The cutlery basket of claim 15, wherein first and third protrusions are configured such that one end that passes through each of the first and third holes is bent toward an upper side.

19. The cutlery basket of claim 15, wherein first to third protrusions are arranged at regular intervals along length directions of the first and second fasteners.

* * * * *